US005694717A

United States Patent [19]

Gier

[11] Patent Number: 5,694,717

[45] Date of Patent: Dec. 9, 1997

[54] WINDOW WINDER OF THE BOWDEN TYPE FOR A VEHICLE DOOR

[75] Inventor: Achim Gier, Wesendorf, Germany

[73] Assignee: Rockwell Light Vehicle Systems, Inc.

[21] Appl. No.: 568,926

[22] Filed: Dec. 7, 1995

[30] Foreign Application Priority Data

Dec. 7, 1994 [FR] France ..... 94 14724

[51] Int. Cl.[6] ..... E05F 11/48

[52] U.S. Cl. ..... 49/352; 49/348

[58] Field of Search ..... 49/348, 349, 350, 49/351, 352

[56] References Cited

U.S. PATENT DOCUMENTS 4,934,099 6/1990 Maekawa et al. ..... 49/352

5,398,449 3/1995 Kobreheu et al. ..... 49/352

FOREIGN PATENT DOCUMENTS

3925864A1 8/1989 Germany .

*Primary Examiner*—Jerry Redman

[57] ABSTRACT

The window winder comprises at least one guide rail (2) for a slider (4) slidably mounted on this rail and supporting the wiondow glass (1), at least one cable (11, 8, 6) passing round at least one return pulley (14 . . . ) mounted on one end of the rail, and a driving element (13) driving the cable(s). The slider (1) is made in at least two parts, namely a front guide part (4*a*) slidable on the rail (2) and a rear part (4*b*) which supports the window glass and is mounted on the front part to be slidable through a given travel, the cable being fixed to the rear part (4*b*). These two parts are slidable relative to the rail and relative to one another, so that, at the end of the travel of the front part (4*a*) along the rail, the rear part can slide through said given travel. This arrangement permits reducing the height of the guide rails of window winders of the Bowden cable type without modifying the travel of the slider(s) and of the window glass and facilitating the mounting of these window winders.

9 Claims, 3 Drawing Sheets

WINDOW WINDER OF THE BOWDEN TYPE FOR A VEHICLE DOOR

BACKGROUND OF THE INVENTION

The present invention relates to a window winder for a vehicle door comprising at least one guide rail for a cursor or slider slidably mounted on said rail and supporting the window glass, and at least one cable passing round at least one return pulley mounted on an end of the rail, said window winder being completed by driving means for the cable or cables.

In particular the window winder of the invention is of the "Bowden" cable type and has two guide rails, namely a front rail and a rear rail.

An object of the invention is to reduce the height of the rail when the window winder has a single guide rail, or the height of one of the guide rails when it comprises two of said rails, without however modifying the travel of the window glass so as to facilitate the mounting of the window winder.

SUMMARY OF THE INVENTION

In known window winders, it is known that the sliders are in one piece, are slidable on the rails and transmit to the window glass the displacement determined by the cable driven by the driving means (manual or motorized). Thus, the length of the rails of a conventional window winder results from the following data: if the slider moves from one end of the rail to the other without extending beyond the rail, the length of the rail is equal to the sum of the height of the slider and of the travel of the window glass at the place at which it is fixed to the slider. This length may in some cases create difficulties in the mounting of the rails in the door, for example if the travel of the window glass is large relative to the size of the box structure of the door.

An object of the invention is therefore to reduce the length of the rail so as to facilitate the mounting of the window winder.

According to the invention, the slider is made in at least two parts, namely a front first guide part slidable on the rail and a rear second part supporting the window glass and mounted on said front part to be slidable through a given travel, the cable being fixed to the rear part, said two parts therefore being slidable relative to the rail and one part being slidable on the other part so that, at the end of the travel of said front part of the slider on the rail, the rear part of the slider is slidable through said given travel on the front part after said front part has reached a stop.

Thus, if the front part of the slider moves from one end to the other of the rail without travelling beyond the ends of the latter, the length of the rail is equal to the sum of the height of the front part of the slider and its travel, diminished by the sliding travel of the rear part on the front part of the slider. As compared to the length of a conventional guide rail, the length of the rail of the window winder according to the invention is therefore diminished by the relative travel between the rear part and the front part.

Further features and advantages of the invention will be apparent from the following description with reference to the accompanying drawings which illustrate several embodiments by way of non-limitative examples.

DESCRIPTION OF THE PREFERRED EMBODIMENTS

Figure 1:
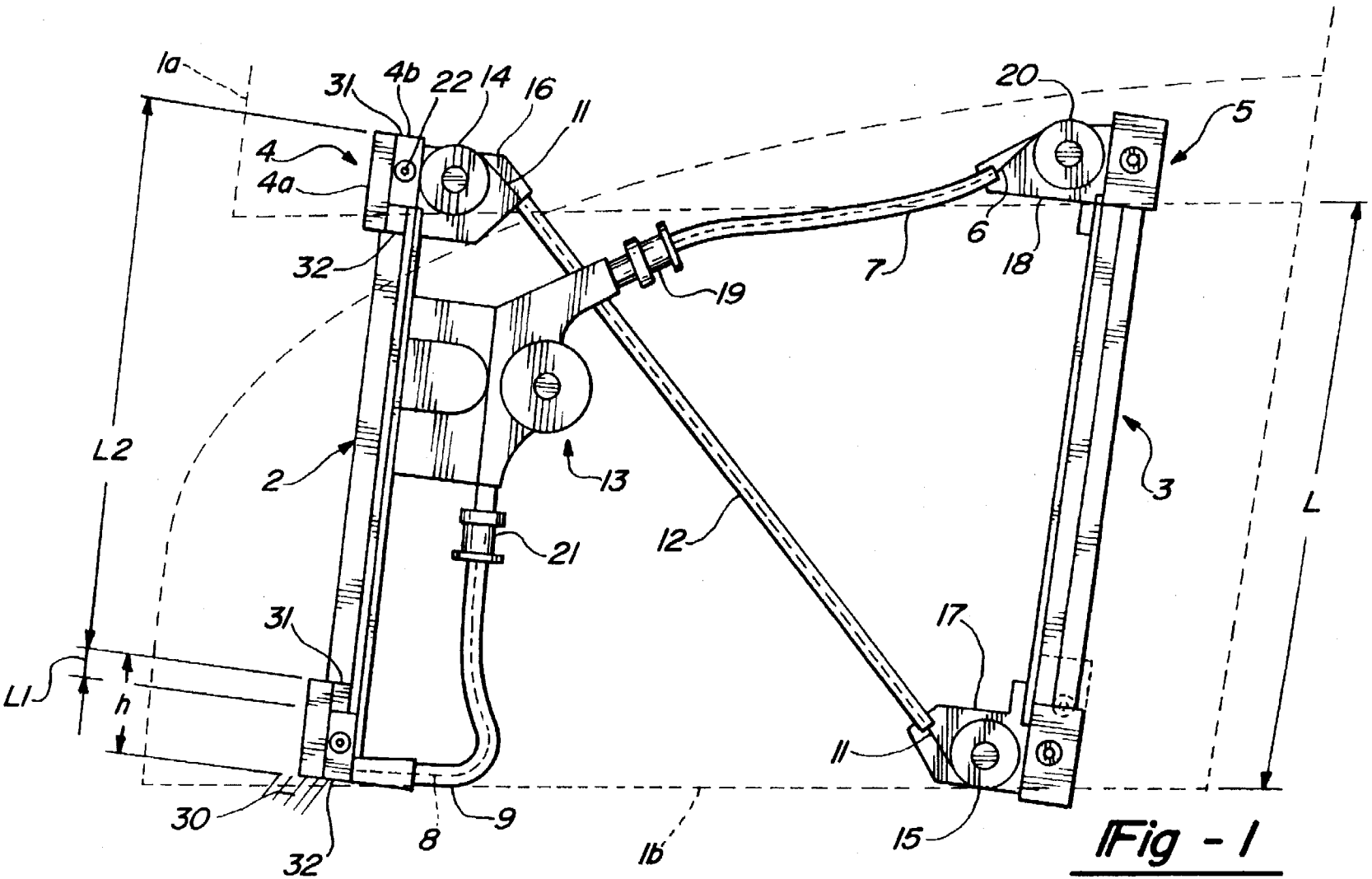
FIG. 1 is a simplified elevational view of a first embodiment of a window winder for a vehicle door according to the invention, of the type having two guide rails and in which the front slider is made in two parts.

The window winder shown in the drawings is adapted to control the raising and the lowering of a window glass 1 of a vehicle door (not shown) between an upper position carrying the reference numeral 1*a* and a lower position carrying the reference numeral 1*a* separated by a travel L.

This window winder of the "Bowden" cable type, comprises a front guide rail 2 and a rear guide rail 3 and two respective sliders 4 and 5 supporting the window glass 1 and slidably mounted on the respective rails 2 and 3. The window winder further comprises a system of cables disposed between the rails 2 and 3: an upper cable 6 in a sheath 7, a lower cable 8 in a sheath 9 and an intermediate cable 11 in a sheath 12. The front rail 2 carries driving means 13 for driving the cables which is manual or motorized and is known in the art.

The intermediate cable 11 is received at its opposite ends on return pulleys 14, 15 mounted on supports 16, 17 which are respectively fixed to the upper end of the rail 2 and to the lower end of the rail 3. One of the ends of the upper cable 6 passes round a third return pulley 20 mounted on a support 18 fixed to the upper end of the rail 3. The upper cable 6 and the lower cable 8 are interconnected in the driving means 13. Compression coil springs 19, 21 are interposed between the ends of the sheaths 7 and 9 and the driving means 13. As the window glass 1 is carried by the sliders 4 and 5, it can rise or descend according to the driving direction of the means 13.

One of the sliders 4 and 5, namely the front slider 4 in the embodiment shown in the drawings, is divided into two parts. The front slider 4 therefore comprises a front first guide part 4*a* slidable on the rail 2, and a rear second part 4*b* supporting the window glass 1 by means of a fixing member 22 known per se, to which rear part 4*b* the cable 11 is fixed. The rear part 4*b* of the slider is mounted on the front part 4*a* to be slidable through a given relative travel $L_1$. The two parts 4*a*, 4*b* are also slidable together relative to the rail 2, so that, at the end of their travel along the rail 2, the rear part 4*b* is slidable through the travel $L_1$ relative to the front part 4*a* after the front part 4*a* has reached a stop, for example the lower stop 30.

In the embodiment illustrated in FIG. 1, the front part 4*a* does not project from the ends of the rail 2 at the end of the descending or rising travel, and the length of the rear part 4*b* is less by the relative travel $L_1$ than the length of the front part 4*a*. As the rising or descending travel of the front part 4*a* is equal to $L_2$, it can be seen that the height of the front guide rail 2 is equal to: $L_2$+the height h of the front part 4*a*–$L_1$. This height of the rail 2 is therefore shorter by the distance $L_1$ than the height of a conventional rail.

At the end position 1*a* of the downward travel of the window glass, the front part 4*a* first of all reaches the lower stop 30, then the window glass continues to descend a further travel $L_1$ to its final position 1b owing to the sliding of the rear part 4b on the front part 4a.

The travel L of the window glass 1 results from the sum of the travel $L_2$ of the part 4a increased by the relative travel $L_1$ between the part 4b and the part 4a.

Figures 2, 3A, 3B, 3C:
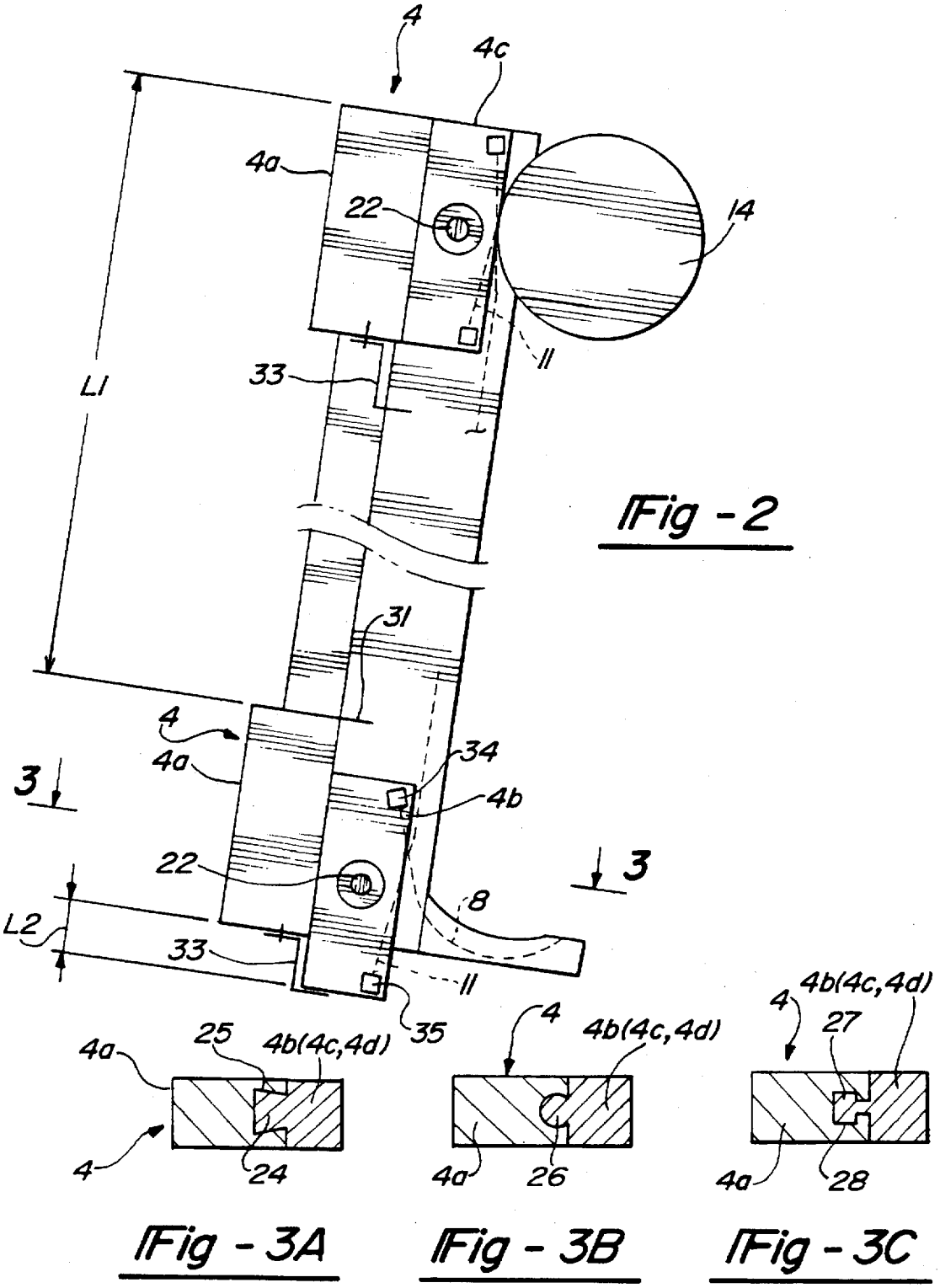
FIG. 2 is a partial elevational view to a larger scale of a guide rail provided with a slider according to the invention, constructed in accordance with a second embodiment of the front slider of FIG. 1.
FIGS. 3A, 3B, and 3C are sectional views, taken on line 3—3 of FIG. 2, illustrating three possible embodiments of the system of the slidable mounting of the rear part on the front part of the slider.

The two parts 4a and 4b may be slidably assembled by suitable complementary cross-sectional shapes such as those shown in FIGS. 3A to 3C. In FIG. 3A the part 4b of the slider is provided with a dovetail portion 24 engaged in a complementary longitudinal groove 25 in the part 4a. In FIG. 3B, the part 4b has a lateral cylindrical projection received in a complementary cylindrical groove in the part 4a. In FIG. 3C, the part 4b is provided with a lateral projection 27 of a T-shaped section received in a complementary longitudinal groove 28 in the part 4a.

Stop means are advantageously provided for limiting the relative travel $L_2$ between the rear part 4b and the front part 4a, such as for example transverse lugs 31, 32 fixed to the opposite ends of the front part 4a of the slider 4. These stop means may also be formed by the closed ends of the groove such as 25 and 28 in the front part 4a, which consequently constitute end-of-travel stops for the associated male parts 24, 26, 27.

These stop means are only proposed as examples and may of course be replaced by any other suitable equivalent means. Thus in the second embodiment of the slider 4 illustrated in FIG. 2, the lower end of the front part 4a may be provided with an L-shaped lug 33 as the stop for the rear part 4c. The length of the latter is here equal to that of the front part 4a, whereas in the embodiment shown in FIG. 1, the height of the rear part 4b is less by the distance $L_1$ than the height of the front part 4a.

Indeed, the height of the two parts 4a, 4b may vary in accordance with the application. The height of the rail 2 (or possibly the rear rail 3 if it has a slider which is divided into two parts) is directly related to the length of the part 4a, to its travel $L_1$ and to the relative travel between the two parts 4a, 4b. The dimensions of the front part 4a must therefore be small but however sufficient to ensure a good guiding stability. The rear part 4b may have a length less than or equal to that of the front part 4a, which then enables the rear part 4b to avoid travelling beyond the front part 4a at one or at both ends of the rail 2, 3.

Figure 4:
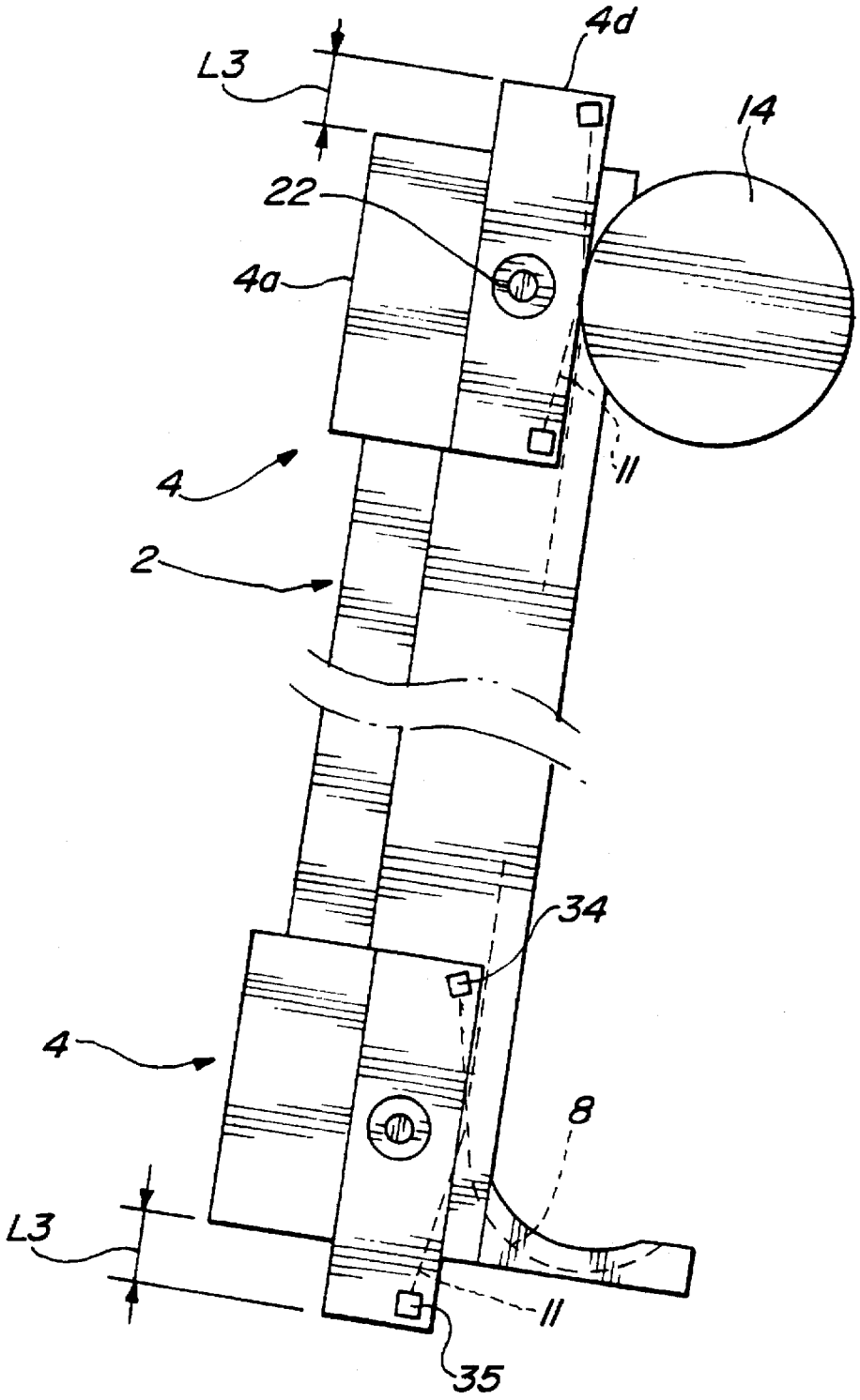
FIG. 4 is a partial elevational view similar to FIG. 2 of a third embodiment of the slider with which a window winder according to the invention may be equipped.

But in some cases, such as that illustrated in the alternative embodiment shown in FIG. 4, it may be advantageous to arrange that the rear part 4d have a length exceeding that of the front part 4a so as to facilitate the fastening of the fixing members 22 to the window glass 1, this depending on the overall size of each door.

In the embodiment shown in FIG. 4 the length of the slider formed by the rear part 4d exceeds by a value $L_3$ that of the front 4a, $L_3$ then being equal to the relative travel between the rear part 4d and the front part 4a.

In the various possible embodiments of the window winder, the cables 8 and 11 are fixed to the rear part 4b, 4c or 4d in a suitable manner, for example as shown diagrammatically in FIGS. 2 and 4 by means of terminal heads 34, 35 contained within the slider 4b 4c, 4d.

In any case, the reduction in the length of the rail 2 (or 3) or of the single rail if the window raiser has a single rail and a single cable, is achieved without modification of the travel of the window glass.

Many modifications may be made in the window winder according to the invention and the slider may be divided into more than two parts. As already mentioned, it is applicable to window widers having a single guide rail.

What is claimed is:

1. A window winder for a vehicle door, mid winder comprising:

a window glass;

a guide rail having first and second ends, a slider slidably mounted on said rail, a return pulley mounted adjacent said first end of said rail, cable means passing round said pulley, and driving means connected to said cable means for driving said cable means, said slider having a first guide part slidably mounted on said rail and a second guide part supporting said window glass, said second guide part mounted on said first guide part, said second guide part slidable through a first travel relative to said first guide part, said cable means fixed to said second guide part, said first and second guide parts of said slider adapted to slide in unison relative to said rail through a second travel, said travel delimited at one end by a first stop means said first guide past further slidable relative to said second guide part whereby, at one end of said second travel of said first guide part on said rail as determined by said first guide part sliding to said first stop means, said second guide part slides on said first guide part through said first travel.

2. A window winder according to claim 1, wherein said second guide part of said slider is less in length than the length of said first guide part of said slider.

3. A window winder according to claim 2, further comprising a second stop means for limiting the relative travel between said second guide part and said first guide part of said slider.

4. A window winder according to claim 3, wherein said second stop means comprises lugs fixed to first and second ends of said first guide part of said slider.

5. A window winder according to claim 3, further comprising:

a longitudinal groove in said first guide part having first and second ends, and a complementary male portion located on said second guide part slidably mounted in said groove, said second stop means comprising said first and second ends of said longitudinal groove being closed.

6. A window winder according to claim 1, wherein said second guide part of said slider is equal in length to the length of said first guide part of said slider.

7. A window winder according to claim 1, wherein said second guide part of said slider is greater in length than the length of said first guide part of said slider. and said first guide part of said slider.

8. A window winder for a vehicle door, said winder comprising:

a window glass, a first guide rail and a second guide rail, first and second sliders for supporting said window glass, said first and second sliders respectively slidably mounted on said first and second rails, first and second return pulleys mounted on said first and second rails, at least one cable passing round said first and second return pulleys, and driving means associated with said at least one cable for driving said cable, said first slider having a first guide part slidable on said first rail and further having a second guide part supporting said window glass, said second guide part mounted on said first guide part and slidable relative to said first guide part through a first travel, said first rail having stop means for limiting the travel of said first guide part along said first tail, said at least one cable fixed to said second guide part, said first and second guide parts slidable relative to said first rail and said second guide part slides on said fist guide part through said first travel when said first guide part has reached said stop means.

9. A window winder according to claim 8, wherein said at least one cable comprises first and second cables passing round said first and second return pulleys.

* * * * *